United States Patent [19]

Wallace

[11] Patent Number: 4,862,544

[45] Date of Patent: Sep. 5, 1989

[54] KNIFE BLADE SPANNER WRENCH

[75] Inventor: William D. Wallace, Syracuse, N.Y.

[73] Assignee: Remington Arms Company, Wilmington, Del.

[21] Appl. No.: 100,759

[22] Filed: Sep. 24, 1987

[51] Int. Cl.[4] ..... B26B 11/00

[52] U.S. Cl. ..... 7/118; 7/138; 7/168; 30/355; 81/3.05; 81/176.1

[58] Field of Search ..... 30/351, 353, 155–161, 30/346.61, 355; 7/118, 119, 138, 165, 169, 170, 168; 81/3.05, 176.1, 176.15

[56] References Cited

U.S. PATENT DOCUMENTS 149,806 4/1874 Swan .
613,693 11/1898 Martin ..... 7/188 X
673,609 5/1901 Sullivan .
961,515 6/1910 Montgomery ..... 7/138
1,115,780 11/1914 Champlin ..... 7/119
4,648,145 3/1987 Miceli ..... 7/158

FOREIGN PATENT DOCUMENTS 598155 2/1948 United Kingdom ..... 7/169

*Primary Examiner*—Douglas D. Watts
*Attorney, Agent, or Firm*—Donald W. Huntley

[57] ABSTRACT

A knife blade suitable for use as a spanner wrench in the installation and removal of choke tubes in shotguns, characterized by recesses on one edge, preferably matching the diameters of 12 and 20 gauge shotguns.

8 Claims, 1 Drawing Sheet

KNIFE BLADE SPANNER WRENCH

BACKGROUND OF THE INVENTION

In the use of shotguns, it is often desirable to install choke tubes at the end of the barrel to modify the shot pattern of the gun. The choke tubes typically screw into threads formed in the ends of the barrels, using a tool supplied with the tube. It has been found inconvenient for hunters to carry separate tools to install and remove the choke tubes for varying sizes of shotguns, but a suitable alternative has heretofore not been available.

SUMMARY OF THE INVENTION

The present invention relates to an improved spanner wrench which is in the form of a knife blade and is useful for the removal of choke tubes in, for example, 12 and 20 gauge shotguns.

Specifically, the instant invention provides, in a knife blade having a proximal and a distal end and a front and a back edge, the proximal end being adapted for attachment to a handle, the improvement wherein the front edge of the blade has recesses formed therein defining at least a first and a second span.

Preferably, the first span has a length of about 0.685 inch, and the second span has a length of about 0.800 inch.

DETAILED DESCRIPTION OF THE INVENTION

Figure 1:
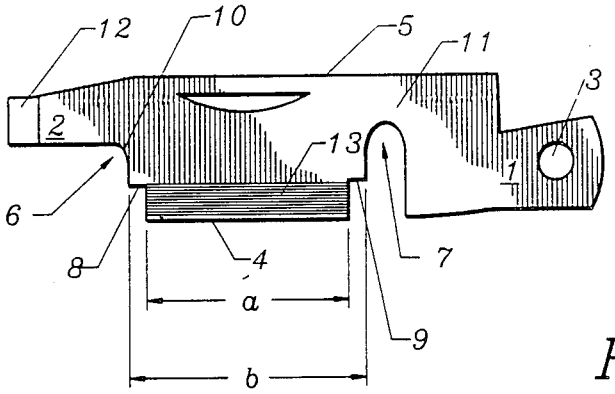
FIG. 1 is view of one embodiment of a knife blade of the present invention.

The invention will be more fully understood by reference to the drawings, in which FIG. 1 is a plan view of one embodiment of a knife blade of the present invention. In that FIG., the knife blade has proximal end 1 and distal end 2. The proximal end is adapted for attachment to a handle through aperture 3 formed therein.

The blade has front edge 4 and back edge 5, front and back respectively referring to the edges that are enclosed and exposed in a folded pocket knife. The recesses which form the crux of the present invention are formed on the front edge of the blade. In the blade of FIG. 1, the recesses 6 and 7 are formed in distinct steps to define two spans. First steps 8 and 9 are right angles formed to define a first span a, while second steps 10 and 11 are curved about a radius and formed in the edge to define a second span b To accommodate the choke tubes used for a Remington 20 gauge shotgun, the first span preferably has a length of about from 0.680 to 0.685 inch. To accommodate the diameter of the choke tubes used for a Remington 12 gauge shotgun, the second span should have a length of about from 0.795 to 0.800 inch.

Each recess in the blade should be wide enough to accommodate the combined wall thicknesses of the choke tube and the barrel into which the choke tube is inserted. In general, a recess width of at least about 0.15 inch, and preferably at least about 0.18 inch, are used.

In a preferred embodiment of the invention, the distal end of the blade is shaped into a screwdriver. A blade tip 12 which is about 0.150 inch wide and formed to a thickness of about from 0.030 to 0.040 inch, and especially about 0.035 inch, has been found to be particularly useful for the adjustment of sights used on firearms, and serves as a convenient extractor replacement implement.

In another preferred embodiment of the invention, the blade edge 13 between the recesses is bevelled or tapered slightly. With standard thicknesses of blade metal, this permits the use of the edge as a loosening tool for a magazine cap, and the whole blade can enter the magazine to remove the spring retainer.

A third step in the recesses, with spacing appropriate, for example, for a 10-gauge shotgun choke, can also be provided on the blades of the present invention.

Figure 2:
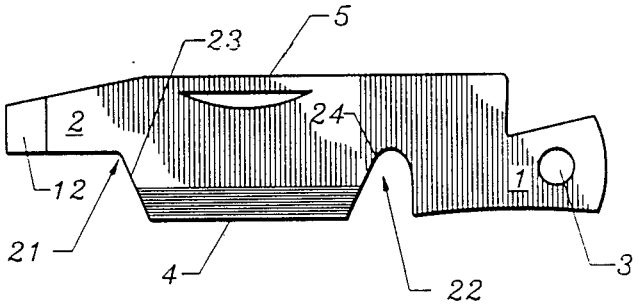
FIG. 2 is a plan view of another embodiment of a knife blade of the present invention.

In still another embodiment of the invention, illustrated in FIG. 2, recesses 21 and 22 are formed into the front edge of the blade and can be partly defined by slanted edges 23 and 24, which define a variety of spans along the length of the slant.

The blades of the present invention can be prepared from materials of the type normally used in blade manufacture. Of these, stainless steel is preferred, and 410 and 420 stainless steels have been found to be particularly satisfactory. Thicknesses can vary with the particular knife construction desired. However, a thickness of at least about 0.072 inch, and especially 0.095 inch, has been found to give the strength characteristics normally required for the intended use, and is consistent with the other components used in knife manufacture.

The present invention provides a single tool, conveniently adapted for a pocket knife, which replaces the larger and bulkier wrenches that have long been used for the installation and extraction of choke tubes in shotguns.

I claim:

1. In a pocket knife blade having a proximal and a distal end and an inner and an outer edge, the proximal end being adapted for attachment to a handle, the improvement wherein the inner edge of the blade has at least two pairs of recesses formed therein defining at least a first and a second span, the second span being greater than and including the first span each pair of recesses being substantially equidistant from the edge of the blade.

2. A knife blade of claim 1 wherein the first span has a length of about 0.685 inch, and the second span has a length of about 0.800 inch.

3. A knife blade of claim 1 wherein both recesses are stepped, the first steps of each recess defining the first span and the second steps of each recess defining the second span.

4. A knife blade of claim 1 wherein the adjacent sides of the recesses are slanted towards each other.

5. A knife blade of claim 1 wherein the distal end of the blade is shaped into a screwdriver.

6. A knife blade of claim 5 wherein the distal end of the blade is about 0.150 inch wide and has a thickness of about 0.030 to 0.040 inch.

7. A knife blade of claim 6 wherein the distal end of the blade has a thickness of about 0.035 inch.

8. A knife blade of claim 1 wherein each recess is at least about 0.15 inch wide.

* * * * *